US008976214B2

(12) United States Patent
Kueckendahl et al.

(10) Patent No.: US 8,976,214 B2
(45) Date of Patent: Mar. 10, 2015

(54) DEVICE FOR MARKING AND/OR SCANNING AN OBJECT

(75) Inventors: Peter Joerg Kueckendahl, Bad Oldesloe (DE); Daniel Joseph Ryan, Sycamore, IL (US)

(73) Assignee: Alltec Angewandte Laserlicht Technologie GmbH, Selmsdorf (DE)

( * ) Notice: Subject to any disclaimer, the term of this patent is extended or adjusted under 35 U.S.C. 154(b) by 0 days.

(21) Appl. No.: 13/976,832

(22) PCT Filed: Dec. 22, 2011

(86) PCT No.: PCT/EP2011/006517

§ 371 (c)(1),
(2), (4) Date: Jun. 27, 2013

(87) PCT Pub. No.: WO2012/089322

PCT Pub. Date: Jul. 5, 2012

(65) Prior Publication Data

US 2013/0286148 A1 Oct. 31, 2013

(30) Foreign Application Priority Data

Dec. 30, 2010 (EP) ..... 10016200

(51) Int. Cl.
*B41J 2/47* (2006.01)
*B41J 2/45* (2006.01)
(Continued)

(52) U.S. Cl.
CPC ..... *B41J 2/435* (2013.01); *B41J 2/2142* (2013.01); *B41J 2/2139* (2013.01); *B41J 2/46* (2013.01)
USPC ..... 347/225; 347/117; 347/238; 347/20; 347/40

(58) Field of Classification Search
USPC ..... 347/225, 117, 238, 20, 40, 224, 111, 347/166
See application file for complete search history.

(56) References Cited

U.S. PATENT DOCUMENTS 4,707,063 A 11/1987 Plummer
5,399,032 A 3/1995 Itoh et al.
(Continued)

FOREIGN PATENT DOCUMENTS

DE 2401322 1/1974
DE 3826113 A1 2/1989
(Continued)

OTHER PUBLICATIONS

International Application No. PCT/EP2011/006517, Written Opinion of International Search Authority.
(Continued)

*Primary Examiner* — Sarah Al Hashimi
(74) *Attorney, Agent, or Firm* — Hoffman Warnick LLC

(57) ABSTRACT

The invention relates to a device for marking and/or scanning an object comprising a head, in particular a marking head or a scanning head, having a plurality of regular operating elements for marking and/or scanning the object, and comprising a driving mechanism for providing a relative movement of the object relative to the head in an advance direction during a working operation, at least a part of the regular operating elements being arranged in a rectangular pattern of rows and columns. The inventive device is characterized in that at least one spare operating element is provided, which is idle in case that all regular operating elements are functioning, the at least one spare operating element is movable relative to the regular operating elements, in case that one of the regular operating elements is defective, the at least one spare operating element is movable into a position in which the defective operating element is replaced by the spare operating element and the at least one spare operating element is settable to an active state. The invention further relates to a method for marking and/or scanning an object.

14 Claims, 6 Drawing Sheets

(51) Int. Cl.

| | |
|---|---|
| ***B41J 2/385*** | (2006.01) |
| ***B41J 2/015*** | (2006.01) |
| ***B41J 2/15*** | (2006.01) |
| ***B41J 2/21*** | (2006.01) |
| ***B41J 2/435*** | (2006.01) |
| ***B41J 2/46*** | (2006.01) |

(56) References Cited

U.S. PATENT DOCUMENTS

| | | | | |
|---|---|---|---|---|
| 5,477,259 | A | 12/1995 | Iwasa | |
| 5,777,634 | A * | 7/1998 | Okamura et al. | 347/7 |
| 5,784,098 | A | 7/1998 | Shoji et al. | |
| 6,189,991 | B1 | 2/2001 | Wen et al. | |
| 6,286,927 | B1 | 9/2001 | Taneya et al. | |
| 6,381,377 | B1 | 4/2002 | Wang | |
| 6,469,729 | B1 | 10/2002 | Ryan | |
| 6,738,086 | B2 | 5/2004 | Oka | |
| 6,855,921 | B1 | 2/2005 | Stopperan et al. | |
| 7,354,130 | B2 | 4/2008 | Arakawa | |
| 7,448,719 | B1 * | 11/2008 | Newell | 347/19 |
| 7,564,020 | B2 | 7/2009 | Sergyeyenko | |
| 7,671,337 | B1 | 3/2010 | Tidwell | |
| 7,908,968 | B2 | 3/2011 | McCoin et al. | |
| 2002/0001004 | A1 | 1/2002 | Mantell et al. | |
| 2002/0101469 | A1 | 8/2002 | Wade et al. | |
| 2002/0139273 | A1 | 10/2002 | Murata et al. | |
| 2002/0191069 | A1 | 12/2002 | Oka | |
| 2003/0016348 | A1 | 1/2003 | Sallee | |
| 2003/0210861 | A1 | 11/2003 | Weiss et al. | |
| 2003/0235373 | A1 | 12/2003 | Ishii et al. | |
| 2004/0160478 | A1 | 8/2004 | Weijkamp et al. | |
| 2005/0122548 | A1 * | 6/2005 | Cunnigan et al. | 358/494 |
| 2005/0123303 | A1 | 6/2005 | Guttman et al. | |
| 2005/0140770 | A1 | 6/2005 | Kang et al. | |
| 2005/0286093 | A1 * | 12/2005 | Sumi et al. | 358/474 |
| 2006/0066924 | A1 | 3/2006 | Delueg | |
| 2006/0109525 | A1 | 5/2006 | Evans | |
| 2007/0091132 | A1 | 4/2007 | Lim | |
| 2007/0279713 | A1 | 12/2007 | Feng et al. | |
| 2008/0055352 | A1 | 3/2008 | Toh et al. | |
| 2008/0246962 | A1 | 10/2008 | Yang | |
| 2010/0002057 | A1 | 1/2010 | Hatasa et al. | |
| 2010/0214387 | A1 | 8/2010 | Fox et al. | |
| 2010/0231929 | A1 | 9/2010 | Kakigi | |
| 2013/0021398 | A1 | 1/2013 | Mizes et al. | |
| 2013/0286147 | A1 | 10/2013 | Kueckendahl et al. | |
| 2013/0286148 | A1 | 10/2013 | Kueckendahl et al. | |
| 2013/0286149 | A1 | 10/2013 | Kueckendahl et al. | |
| 2013/0293658 | A1 | 11/2013 | Kueckendahl et al. | |
| 2013/0328978 | A1 * | 12/2013 | Sekino et al. | 347/85 |
| 2013/0342823 | A1 | 12/2013 | Kueckendahl et al. | |

FOREIGN PATENT DOCUMENTS

| | | | |
|---|---|---|---|
| EP | 0121369 | A2 | 10/1984 |
| EP | 0832754 | B1 | 12/1993 |
| EP | 0832752 | A2 | 4/1998 |
| EP | 1266763 | A1 | 12/2002 |
| EP | 1640169 | A3 | 9/2005 |
| EP | 1640169 | A3 | 10/2007 |
| EP | 2105309 | A1 | 9/2009 |
| JP | 2001332806 | A | 11/2001 |
| JP | 2007090814 | A | 4/2007 |
| JP | 2008126471 | A | 6/2008 |
| WO | 8505187 | A1 | 11/1985 |
| WO | 2006037973 | A1 | 4/2006 |
| WO | 2007107030 | A1 | 9/2007 |
| WO | 2008104222 | A1 | 9/2008 |
| WO | 2009153795 | A1 | 12/2009 |

OTHER PUBLICATIONS

International Application No. PCT/EP2011/006519, Written Opinion of International Search Authority.
International Application No. PCT/EP2011/006519, Preliminary Report on Patentability.
International Application No. PCT/EP2011/006514, Written Opinion of International Search Authority.
U.S. Appl. No. 13/976,804, Office Action dated Jul. 8, 2014.
U.S. Appl. No. 13/976,804, Notice of Allowance dated Mar. 20, 2014.
U.S. Appl. No. 13/976,809, Office Action dated May 27, 2014.
U.S. Appl. No. 13/977,159, Office Action dated Jun. 20, 2014.
U.S. Appl. No. 13/976,832, Notice of Allowance and Fees Due dated Jun. 24, 2014.
U.S. Appl. No. 13/976,793, Office Action dated Jul. 1, 2014.
U.S. Appl. No. 13/977,151, Notice of Allowance and Fees Due dated Aug. 4, 2014.
U.S. Appl. No. 13/977,156, Office Action dated Jul. 9, 2014.
International Application No. PCT/EP2011/006515, International Preliminary Report on Patentability, Jan. 21, 2013.
International Application No. PCT/EP2011/006515, Written Opinion on Search Report.
International Application No. PCT/EP2011/00652023, Written Opinion of International Search Authority.
International Application No. PCT/EP2011/006518, Written Opinion of International Search Authority.
International Application No. PCT/EP2011/006516, Written Opinion of International Search Authority.
International Application No. PCT/EP2011/006520, Written Opinion of International Search Authority.
International Application No. PCT/EP2011/006522, Written Opinion of International Search Authority.
International Application No. PCT/EP2011/006522, International Report on Patentability.
International Application No. PCT/EP2011/006521, Written Opinion of International Search Authority.
International Application No. PCT/EP2011/006521, Written Opinion of International Examining Authority.
U.S. Appl. No. 13/976,814, Notice of Allowance dated Oct. 21, 2014, A581, 72 pages.
U.S. Appl. No. 13/976,804, Final Office Action dated Oct. 24, 2014, A585, pp. 18.
U.S. Appl. No. 13/977,159, Final Office Action dated Oct. 10, 2014, A605, 53 pages.
U.S. Appl. No. 13/977,156, Final Office Action dated Dec. 5, 2014, A617, 13 pages.
U.S. Appl. No. 13/976,793, Notice of Allowance dated Dec. 9, 2014, A609, 66 pages.
U.S. Appl. No. 13/976,779, Notice of Allowance dated Oct. 21, 2014, A601, 34 pages.

* cited by examiner

DEVICE FOR MARKING AND/OR SCANNING AN OBJECT

FIELD OF THE INVENTION

The present invention relates in a first aspect to a device for marking and/or scanning an object.

In a second aspect, the invention relates to a method for marking and/or scanning an object.

RELATED ART

A generic device for marking and/or scanning an object comprises a head, in particular a marking head or a scanning head, having a plurality of regular operating elements for marking and/or scanning the object, and a driving mechanism for providing a relative movement of the object relative to the head in an advance direction during a working operation, at least a part of the regular operating elements being arranged in a rectangular pattern of rows and columns.

In a conventional method for marking and/or scanning an object, the object is moved relative to the head in an advance direction during a working operation, and a marking or scanning of the object is carried out by a plurality of regular operating elements.

It is a general object to keep idle times or times of maintenance as short as possible. In the case that a regular operating element fails, a proper function of the device is no longer possible. Objects being not correctly marked or scanned have to be removed. This is sumptuous and interrupts the operation of the overall machine. Hence, the head has to be replaced or repaired to continue proper working operation.

Rising demands for high resolution applications have led to an ever-increasing amount of regular operating elements. However, as more regular operating elements are used, downtimes appear more frequently. There is thus a need for devices that allow for a good reliability and short downtimes.

SUMMARY OF THE INVENTION

It is an object of the invention to specify a device and a method for marking and/or scanning that allows for a particularly good reliability while providing an extraordinary high precision and resolution.

This objective is solved with a device having the features and a method as described herein.

Embodiments are given in the dependent claims as well as in the following description, in particular in connection with the attached figures.

According to the invention, the device of the above mentioned kind is characterized in that at least one spare operating element is provided, which is idle in case that all regular operating elements are functioning, the at least one spare operating element is movable relative to the regular operating elements, and in case that one of the regular operating elements is defective, the at least one spare operating element is movable into a position in which the defective operating element is replaced by the spare operating element and the at least one spare operating element is settable to an active state.

The method of the above mentioned kind is, according to the invention, characterized in that at least a part of the regular operating elements are arranged in a rectangular pattern of rows and columns, at least one spare operating element is provided and kept in an inactive state as long as all regular operating elements are functioning, in case that one of the regular operating elements is defective, the at least one spare operating element is moved into a position in which it replaces the defective operating element and the at least one spare operating element is activated.

It can be regarded as an idea of the invention to provide an additional operating element which is able to replace a regular operating element. To this end, the additional operating element can be similar or identical to the regular operating elements. Under normal conditions, i.e., if all regular operating elements work properly, the additional operating element is inactive. Thus, the additional operating element may be called a spare operating element or auxiliary operating element. As long as no regular operating element fails, the spare operating element is idle, or, in other words, deactivated or set to an inactive state.

An idea of the invention resides in the fact that the spare operating element is completely connected and only activated if one of the regular operating elements works incorrectly. It is advantageous that one spare operating element is able to replace an arbitrary regular operating element. This means, for a plurality of regular operating elements, only one spare operating element is required to replace any one of the regular operating elements.

However, it is preferred to provide several spare operating elements. It is thus possible to replace several failed regular operating elements.

It can be seen as another idea of the invention to provide for the spare operating elements to be movable relative to the regular operating elements in order to replace a failed regular operating element. Hence, a spare operating element is movable into a position in which it interacts with the same area of the object, with which area the regular operating element to be replaced would interact.

For example, if the regular operating elements are regular marking elements, each regular marking element is positioned such that is can apply a marking to a defined area of the object. According to the invention, the spare operating element which, in this example, may be a spare marking element is positioned such that it can apply a marking to any one of these defined areas.

Such areas to be marked and/or scanned may also be referred to as pixels, lines or dots.

An idea of the invention resides in the provision that the spare operating elements are completely ready for use in the idle or deactivated state. This means, the spare operating elements may already be connected to a control and evaluation unit that drives, i.e. activates and deactivates, the spare operating elements without any further steps being necessary.

If the spare operating element comprises a conductor, e.g. an optical waveguide, for connecting with a marking source or scanning unit, e.g. a light emitting element and/or a light sensing element, this connection has thus been previously established. Therefore, the idle state of a spare operating element is to be understood as a state in which the spare operating element only has to be moved to a certain position for replacing a defective operating element but no further steps being necessary.

The rectangular pattern of regular operating elements may also be called an array, particularly a two-dimensional array. The regular operating elements and the spare operating elements, which may be built identically to the regular operating elements, may also be referred to as pixels.

The rectangular pattern of rows and columns consisting of regular operating elements may be tilted about an axis perpendicular to the advance direction of the object. In particular, the head may be rotatable about an axis being perpendicular to an object's surface to be marked and/or scanned.

In this case, a column of the rectangular pattern is not parallel to the advance direction but slightly inclined. In other words, the regular operating elements of different rows are staggered or displaced to one another in the advance direction. As a consequence, the resolution for marking and/or scanning an object does not solely depend on the distance between two neighbouring regular operating elements of one row. The resolution is rather given by the distance between a regular operating element of one row to another regular operating element of another row in a direction perpendicular to the advance direction.

According to a preferred embodiment of the invention, for replacing the defective operating element, the spare operating element is movable into a position in which it is aligned with the defective operating element in the advance direction. Thus, after a time offset that depends on the speed of movement in the advance direction, the position between the defective operating element and the object corresponds to the position between the spare operating element and the object.

Generally, it may be provided that the spare operating element is movable exactly to the location of a defective regular operating element. This means, the defective regular operating element is removed and physically replaced be the spare operating element. However, it is preferred that the spare operating element replaces a defective regular operating element in the sense that the function of the defective regular operating element is replaced. In this case, the spare operating element is not moved to the location of the defective regular operating element but rather to a position that is offset to the location of the defective regular operating element. This offset lies in the advance direction. Advantageously, no changes at the regular operating elements are thus carried out in replacing a failed or defective regular operating element.

To this end, according to a preferred embodiment of the invention, the head further comprises movement means, the movement means being connected to the at least one spare operating element, and the movement means are movable in order to position the at least one spare operating element relative to the regular operating elements. Advantageously, the time need for moving the spare operating element is thus reduced compared to the case that the spare operating element is moved to the location of a defective regular operating element.

The movement means can be of any kind suited to move the spare operating element or elements. According to an embodiment of the invention, the movement means comprise at least one spare operating element ring, and the spare operating element ring is rotatable in order to position the at least one spare operating element relative to the regular operating elements.

Alternatively, the movement means may comprise at least one slider or carriage onto which the at least one spare operating element is mounted, and the slider or carriage is movable in order to position the at least one spare operating element relative to the regular operating elements.

In case several spare operating elements are provided, each spare operating element is mounted on a respective slider or spare operating element ring. The spare operating elements are thus movable independently from each other.

According to still another preferred embodiment of the invention, the regular operating elements are regular marking elements for applying markings on the object, and the spare operating element is a spare marking element. Alternatively, the regular operating elements are regular scanning elements for scanning the object, and the spare operating element is a spare scanning element.

However, it is also possible that a number of regular operating elements are regular marking elements and another number of regular operating elements are regular scanning elements. Advantageously, markings applied to the object by the regular operating elements can instantly be checked by the regular scanning elements. In this embodiment, at least one spare marking element and/or at least one spare scanning element is provided as a spare operating element.

The regular operating elements may also be receiving spaces equipped with at least one, in particular exactly one, marking element, particularly a printing element.

The regular marking elements may be any elements suited to apply visual marks on the object, in particular laser printing elements, laser engraving elements, inkjet printing elements, needle printing elements, micro pad printing elements, water jet elements and/or electrical discharge machining elements. In order to apply different types of markings to one object, the regular marking elements may cover different types of regular marking elements.

A regular scanning element may be any element that is sensitive to some kind of radiation, such as electromagnetic radiation, visible or nonvisible light, sound waves, or particle waves such as electron beams. In particular, the scanning elements may be light sensitive CCD or CMOS elements.

However, it is preferred that at least one regular operating element comprises an optical fibre which can be coupled to a light emitting element or a light detecting element. If the fibre ends are mounted to receiving spaces that are preferably arranged in a rectangular pattern, ferrules may be used for mounting. The ferrules can be made of e.g. ceramic, plastic or glass. Preferably, a ceramic material, particularly zirconia, is used.

Alternatively or additionally, a number of regular operating elements may comprise mirror elements and particularly form a digital micromirror device, DMD.

The head can also be constructed as a monolithic device in which the regular operating elements form an integral part of the head.

In a preferred embodiment, at least one lens, preferably one lens per regular operating element, is provided in front of the rectangular pattern in order to direct light or other radiation from the regular operation elements to the object and/or vice versa.

Another preferred embodiment of the invention is characterized in that detecting means for detecting a defective operating element is provided. This is useful for replacing the defective operating element and not a working regular operating element.

The detecting means can be, for instance, a control circuit that detects whether an electronic unit connected with the regular operating elements works properly. If the regular operating elements are regular marking elements for laser printing or laser engraving, each regular marking element may comprise a light emitting element, e.g. one laser or LED. In this case, the control circuit is adapted to determine whether a light emitting element is defective.

In a second step, the row and column of the defective operating element within the rectangular pattern is determined. This may be of particular importance if the rectangular pattern is not formed by the light emitting elements themselves but by light guiding elements connected thereto, e.g. optical waveguides. Here, it has to be known to which positions within the rectangular pattern the light guiding elements respectively lead.

To this end, a mapping table containing information which light emitting element is connected with which position within the rectangular pattern may previously be created. This may be done by using a camera that records pictures of the rectangular pattern. The regular marking elements of the rectangular pattern are simultaneously or one after another activated. From the pictures taken by the camera it can subsequently be determined at which position within the rectangular pattern each regular marking element is located.

Alternatively or additionally, the camera can be used for both detecting whether a regular marking element is defective as well as the position of this defective marking element within the rectangular pattern, i.e. a row information and a column information of the defective marking element.

A preferable embodiment of the inventive device is characterized in that a control and evaluation unit is provided which is adapted to determine the position of the defective operating element in the advance direction and in a direction perpendicular to the advance direction. This determination of the position may be achieved by firstly identifying the defective operating element. Secondly, a tilt angle of the head about an axis perpendicular to the advance direction is determined. The position in which a spare operating element replaces a defective operating element can be calculated from the tilt angle and the column information of the failed operating element.

According to another embodiment of the invention, a monitoring element is provided as means for detecting a defective operating element. The monitoring element is adapted to measure markings applied on the object by the regular marking elements. Furthermore, a control and evaluation unit is provided which is adapted to determine whether a regular marking element is defective on the basis of the measured markings on the object.

As each regular marking element applies a marking to a specific area of the object, the regular marking elements can be distinguished by the specific areas on the object. The monitoring element may be for example a light sensing element. If it senses that a marking is not correct, i.e. a specific area is marked improperly, the position to this incorrect marking is allocated to a regular operating element. Thus, the defective operating element can be identified.

Furthermore, it is possible to use the monitoring element for determining a tilt angle of the head. To this end, a single regular marking element may be activated to apply a reference marking on the object. Thereupon, the monitoring element, which may be movable in a direction transverse to the advance direction, is moved until is measures the reference marking. By fundamental geometric equations, the tilt angle can be calculated using the position of the monitoring element. Alternatively or additionally, a plurality of monitoring elements may be provided for determining the position of the reference marking.

Generally, it is possible that the movement means, particularly the at least one spare operating element ring or the at least one slider, is manually movable, in particular manually rotatable. In this embodiment, an indication system may be provided for indicating an operation position of the movement means in which the at least one spare operating element is aligned with the defective operating element in the advance direction. A control and evaluation unit may be provided which is adapted to calculate the operation position from a tilt angle of the head and a column information of the defective operating element. As an indication system, the movement means may have a scale or an angle scale. Furthermore, a display may be provided, e.g., a computer display, for indicating a setting for the scale, e.g. an angle to be set at the angle scale. A user may thus easily move the movement means to the operation position.

However, it is preferred that the head further comprises a motor for positioning the at least one spare operating element. Here, a control and evaluation unit is provided for driving the motor to position the spare operating element into the position in which it is aligned with the defective operating element in the advance direction. In particular, the motor may move the spare operating element via the movement means, e.g. via a slider or a spare operating element ring. Advantageously, by using a motor, the spare operating element can be positioned automatically.

A further embodiment of the invention is characterized in that a spare operating element comprises a mirror which is movable and can be mounted on the movement means, e.g. the slider. In this case, the spare operating element further comprises a spare light emitting and/or receiving element, e.g. an optical waveguide, which is preferably located at a fixed position and directed at the mirror. Advantageously, only the mirror or the mirrors have to be moved for replacing a failed operating element while the spare light emitting and/or receiving elements remain at a fixed position.

According to still another preferred embodiment of the invention, a control and evaluation unit is provided that is adapted to drive the regular operating elements and the at least one spare operating element, i.e. to active and deactivate the elements, in particularly changing a power supply of the elements time-controlled. The control and evaluation unit is further adapted to drive the defective operating element time delayed in case the spare operating element is in an active state, wherein the time delay corresponds to the distance between the spare operating element and the defective operating element in the advance direction divided by the speed of the object relative to the head caused by the driving mechanism.

If, for instance, a marking is to be applied to the object by the defective operating element, the time delay is such that the object has been moved just an amount equal to the distance between the defective operating element and the spare operating element in the advance direction. This distance can be determined from the tilt angle of the head and the row information of the defective operating element.

In the following, the design and arrangement of the rectangular pattern of preferred embodiments will be described in detail.

The rectangular pattern of regular operating elements consists of columns and rows perpendicular thereto. In the rectangular pattern, the regular operating elements are disposed in a manner that in each case four regular operating elements are arranged in the edges of a rectangle. The rectangular pattern may also be referred to as an orthogonal arrangement of regular operating elements.

The distance between regular operating elements is called a pitch. It is preferred that a pitch is common between all neighbouring regular operating elements for the rectangular pattern.

In a preferred variant of the inventive device, the rectangular pattern of regular operating elements is tilted with regard to the advance direction such that the rows extend in a transverse direction relative to the advance direction and the regular operating elements of a successive row of the rectangular pattern are offset with regard to the regular operating elements of a preceding row of the rectangular pattern in a direction perpendicular to the advance direction.

According to another preferred embodiment of the invention, the amount of offset of the regular operating elements of a successive row with regard to the regular operating elements of a preceding row is smaller than a pitch of the regular operating elements of one row.

It is preferred that the rows extend transversely, but not perpendicularly, to the advance direction in order to enhance the resolution. Consequently, the columns also extend transversely to the advance direction.

The advance direction may also be called a product movement direction and is in particular a linear direction.

With the head tilted, the width for marking and/or scanning is defined by a distance in a direction perpendicular to the advance direction between a first regular operating element of a first row and a last regular operating element of a last row, wherein the regular operating elements of the first row and the last row are numbered in the same direction. In other words, the width for marking and/or scanning is defined by the distance in a direction perpendicular to the advance direction of two regular operating elements located diagonally opposite one another.

In a preferred variant of the inventive method, the head is tilted such that the width for marking and/or scanning corresponds to the width of an object to be marked or scanned.

The angle of rotation or tilting angle of the head is defined as the angle between the columns and the advance direction. It is preferably chosen such that a predetermined resolution is achieved, the predetermined resolution being higher than the resolution of a single row of the head.

In another preferred embodiment of the invention, the tilting angle is smaller than 45 degrees, particularly in the range of 1 to 10 degrees, more preferably 2 to 8 degrees, even more preferably 2 to 5 degrees.

In still another preferred embodiment the rectangular pattern of rows and columns is tilted to a degree in which at least a part of the regular operating elements of one row is aligned with at least a part of the regular operating elements of another row in the advance direction. This embodiment provides the option of a multiple mark and/or scan of one and the same pixel.

For a precise movement of the head it is preferred that an electrical device, particularly a motor or a stepper motor, is provided for rotating the head in the range of 0 to 90 degrees, particularly at defined angle steps. The angle steps are in particular steps of less than 1 degree, preferably less than 0.1 degrees.

Concerning the enhancement of resolution by tilting the rectangular pattern, the invention is also based on the following aspect.

Depending on the tilting angle, on the diameter of a regular operating element, and on the pitch between regular operating elements, it might occur that marked and/or scanned areas of the object do overlap. However, the tilting angle is chosen such that at least a number of regular operating elements of one row, i.e. a preceding row, is displaced to a number of regular operating elements of another row, i.e. a succeeding row. As a consequence, the overlap between the marked and/or scanned areas of these regular operating elements is smaller than 100%. i.e. the marked and/or scanned areas are displaced to one another wherein the amount of displacement is smaller than the displacement between marked and/or scanned areas of regular operating elements of one and the same row. Thus, the tilting angle provides for an enhanced resolution.

BRIEF DESCRIPTION OF THE DRAWINGS

The invention will be further described hereinafter with reference to preferred embodiments shown in the enclosed drawings, wherein show.

Equivalent components are respectively referred to in all figures with the same reference signs.

DETAILED DESCRIPTION OF THE INVENTION

Figure 1:
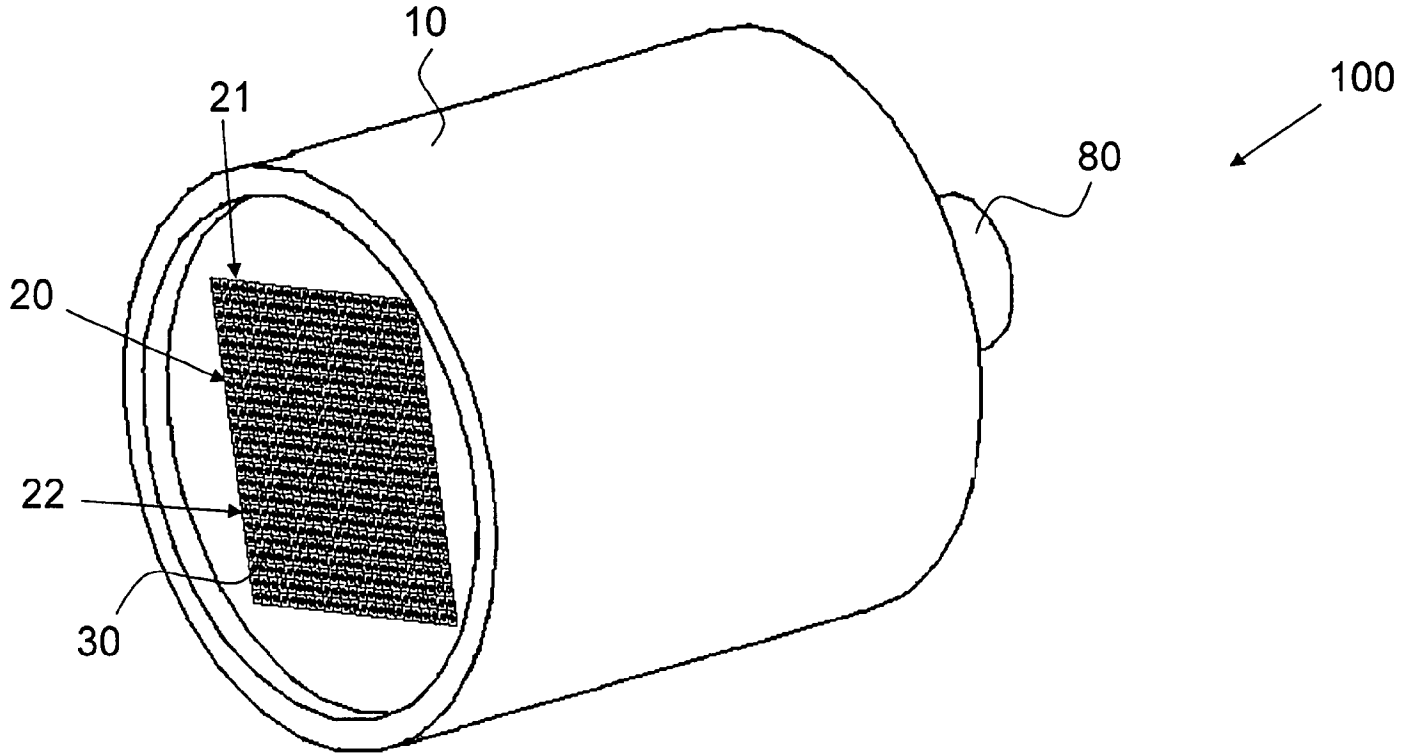
FIG. 1 a perspective view of a first embodiment of an inventive device.

FIG. 1 shows a perspective view of a first embodiment of an inventive device 100 for marking and/or scanning an object. The device 100 comprises a head 10 and connection means 80 for connecting the head 10 to other components, e.g. a control and evaluation unit (not depicted).

The head 10 has a plurality of regular operating elements 30 which are adapted to mark and/or scan an object. The regular operating elements 30 are arranged in a rectangular pattern 20 consisting of rows 21 and columns 22. The rows 21 and columns 22 are disposed perpendicularly to each other.

Figure 2:
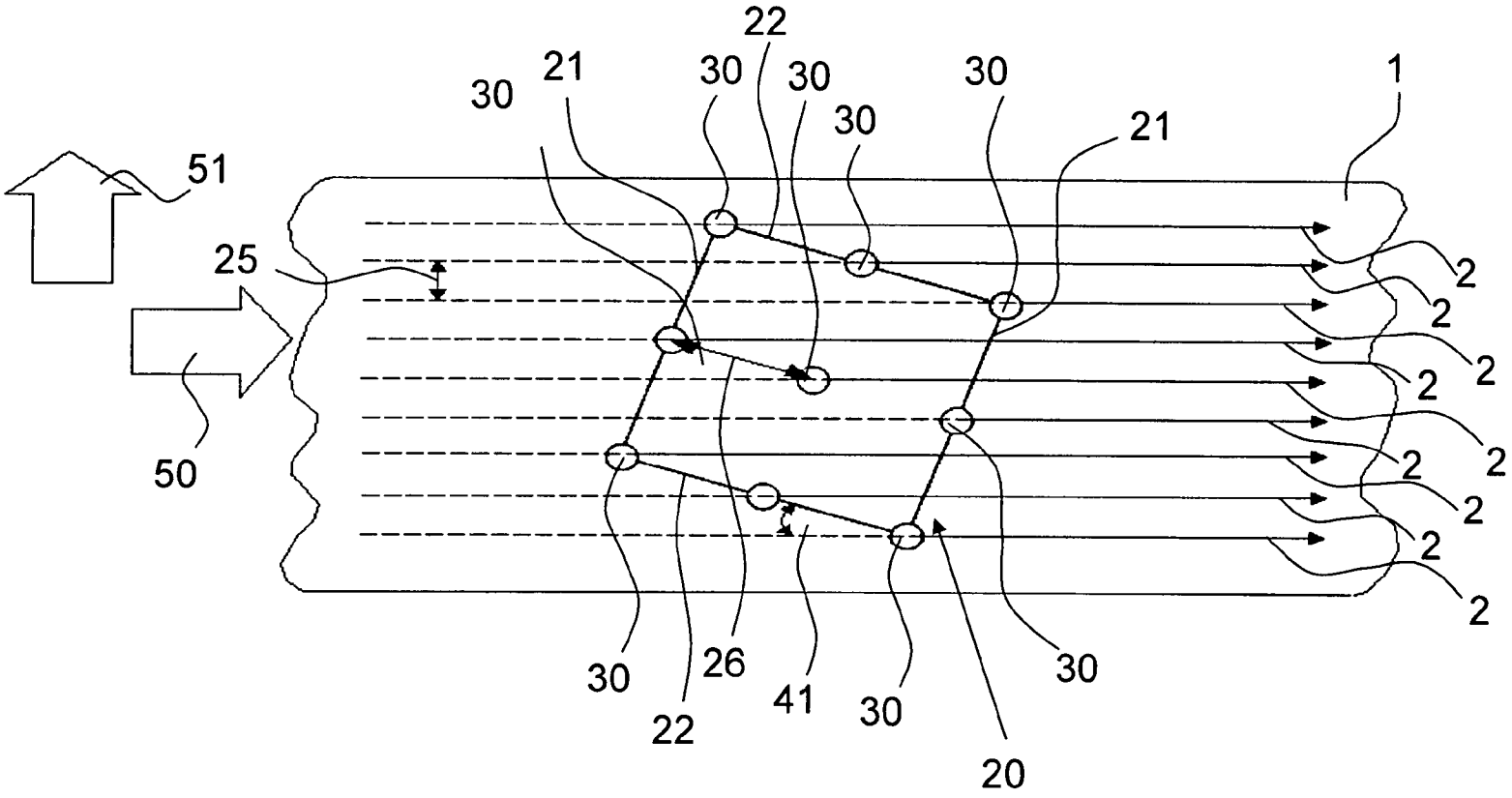
FIG. 2 a schematic diagram of a rectangular pattern of regular operating elements and an object to be marked and/or scanned.

With respect to FIG. 2, a particularly preferred embodiment of a device for marking and/or scanning an object according to the invention will be described. In FIG. 2, a schematic diagram of a rectangular pattern 20 of regular operating elements 30 and an object 1 to be marked and/or scanned is depicted.

The object 1 is moved in an advanced direction 50 by a driving mechanism (not shown) during a working operation. In a working operation, the object 1 is marked and/or scanned with the regular operating elements 30.

Here, the rectangular pattern 20 consists of nine regular operating elements 30 arranged in three rows 21 and three columns 22. The columns 22 are tilted with regard to the advanced direction 50 about a tilting angle 41. The columns 22 are thus not parallel to the advanced direction 50.

As the object 1 is moved, each of the regular operating elements 30 is able to mark and/or scan a specific area of the object 1, i.e. a line 2.

The marking and/or scanning resolution in a direction 51 perpendicular to the advanced direction 50 is given by the distance 25 between two neighbouring regular operating elements 30 of different rows 21, i.e. the distance in the direction 51 perpendicular to the advanced direction 50. The distance 25 may be described by the pitch 26, that is the distance between two neighbouring regular operating elements 30, multiplied with the cosine of the tilting angle 41.

Advantageously, by this tilted arrangement an enhanced resolution is achieved.

Figure 3:
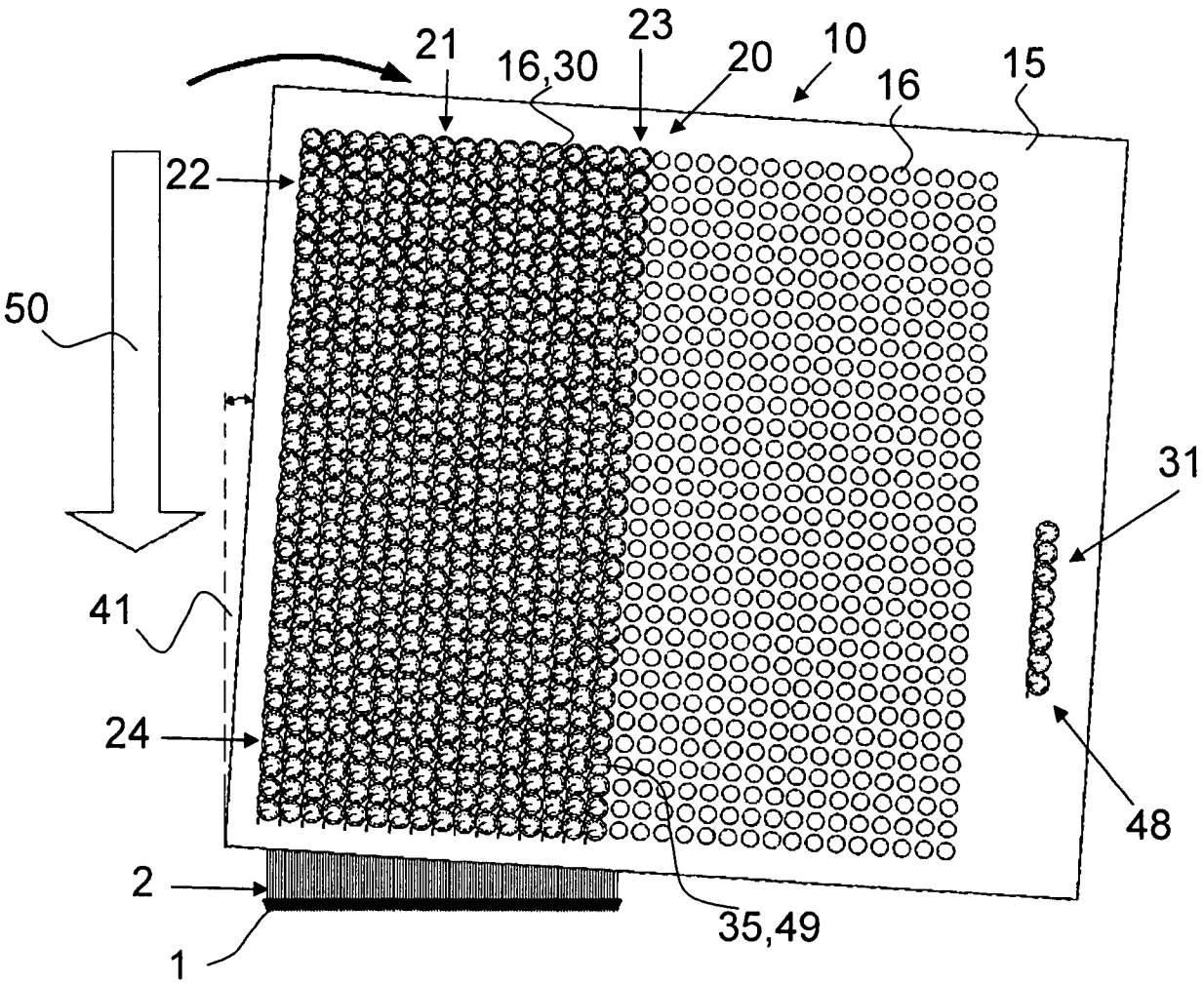
FIG. 3 a schematic diagram of a head of the first embodiment of the device according to the invention.

The use of a spare operating element will be described in the following with reference to FIG. 3 which shows a schematic diagram of the head 10 of the first embodiment of the device 100 according to the invention.

The head 10 may comprise a receiving plate 15 with a plurality of receiving portions 16 arranged in a rectangular pattern. The receiving portions 16 may be holes for receiving a marking and/or a scanning element, e.g. optical wave guides connected to a light emitting element or a light sensor.

In the embodiment shown, only a number of the receiving portions 16 is equipped with regular operating elements 30 forming a rectangular pattern 20. The columns of the rectangular pattern 20 are again tilted with respect to the advanced direction 50 about the tilting angle 41.

The regular operating elements 30 are, in this example, regular marking elements and apply markings 2 onto the object 1.

As the total number of regular operating elements 30 is very large, the risk for failure of one of the regular operating elements is quite high. A failed regular operating element, i.e. a defective operating element 35, cannot mark or scan the object 1 properly. The defective operating element 35 has thus to be replaced.

To this end, the head 10 further comprises a plurality of spare operating elements 31. The spare operating elements 31 are stored in a position 48 outside of the rectangular pattern 20. In this position 48, the spare operating elements 31 do not replace a defective operating element 35 and are kept in an idle state, i.e. they are not used for marking and/or scanning.

However, the spare operating elements 31 are movable into a position 49 in which they replace the defective operating element 35.

In the embodiment shown, the defective operating element 35 is firstly disconnected from its receiving portion 16. Subsequently, a spare operating element 31 is disconnected from its receiving portion and connected to the receiving portion 16 of the defective operating element 35. This connecting/disconnecting can be carried out manually by a user. The total time requirement for this procedure lies in the order of minutes.

A control and evaluation unit (not depicted) may be provided for determining the row 23 and the column 24 of the defective operating element 35. Furthermore, a display (not depicted) may be provided for indicating to a user the row 23 and column 24 of the defective operating element 35 to be replaced.

Figure 4:
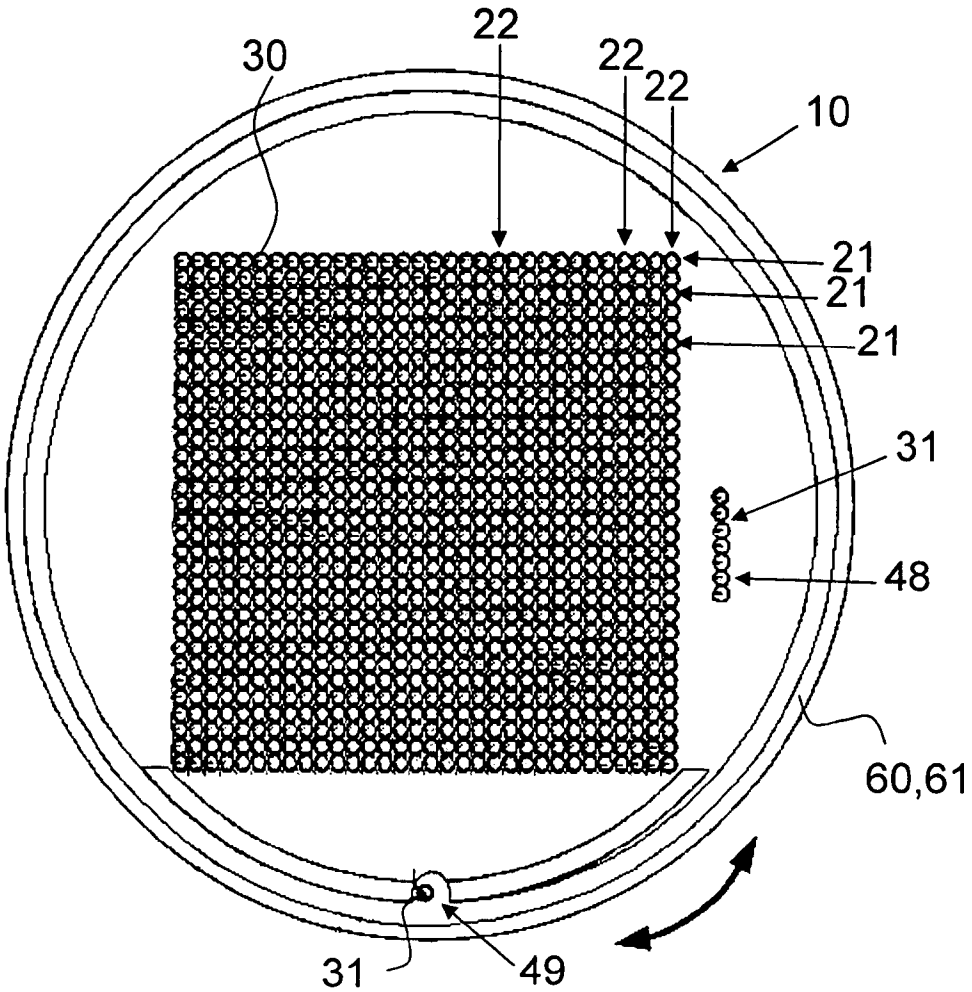
FIG. 4 a schematic diagram of a head of a second embodiment of a device according to the invention.

FIG. 4 shows a schematic diagram of a head 10 of a second embodiment of a device according to the invention. Here, the head 10 comprises again a plurality of regular operating elements 30 disposed in a rectangular pattern of rows 21 and columns 22. Additionally, at least one spare operating element 31 is provided in a position 48 in which it does not replace a defective operating element 35.

The head 10 is further provided with movement means 60 for moving at least one of the spare operating elements 31 relatively to the regular operating elements 30.

In the embodiment shown, the movement means 60 comprises at least one spare operating element ring 61 which is connected to a spare operating element 31. Movement of the spare operating element ring 61 causes the spare operating elements 31 to move relatively to the regular operating elements 30 in a circular fashion.

For each spare operating element 31 one spare operating element ring 61 may be provided in order to move the spare operating elements 31 independently from each other.

Generally, it is possible to manually rotate the spare operating element ring 61. However, in the depicted embodiment, the spare operating element ring 61 is driven automatically by a motor (not shown).

Figure 5:
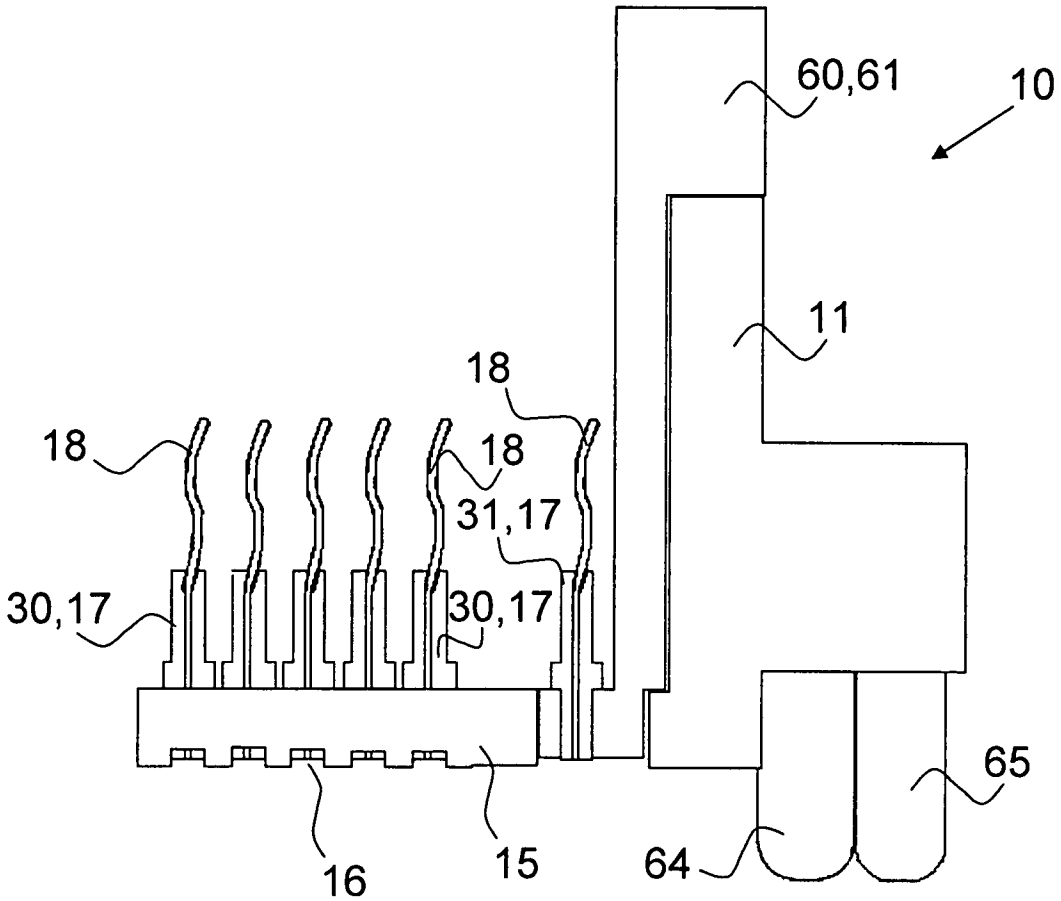
FIG. 5 a cross-sectional partial view of the head of the second embodiment of the device according to the invention.

The head 10 of this embodiment of the device according to the invention is shown in FIG. 5 in a cross-sectional partial view. As can be readily seen, the spare operating element ring 61 is accessible from an environment of the head 10 and can thus be rotated by a user. The head 10 further comprises a base body 11 which cannot be moved by rotating the spare operating element ring 61.

The base body 11 is provided with at least one shielding ring 64, 65 for preventing light or other radiation from passing from an area between the object and the regular operating elements to the environment of the head 10 and vice versa. In the example shown, two shielding rings are provided. An inner shielding ring 64 may be a glass fiber brush ring that breaks, spreads or deludes light, particularly laser light used for marking or scanning the object. An outer shielding ring 65 may be formed from black fibers that absorb light that might have passed the inner shielding ring 64.

Connected to the base body there is a receiving plate 15 which comprises several receiving portions 16 for housing the regular operating elements 30.

In the embodiment shown, each of the regular operating elements 30 and the spare operating element 31 comprises a ferrule 17 and an optical waveguide 18 coupled thereto. The optical waveguides 18 can be connected to a light source for marking, particularly printing onto, an object, and/or to a sensing element, e.g. a CMOS- or a CCD-light sensing element, for scanning the object.

Figure 6:
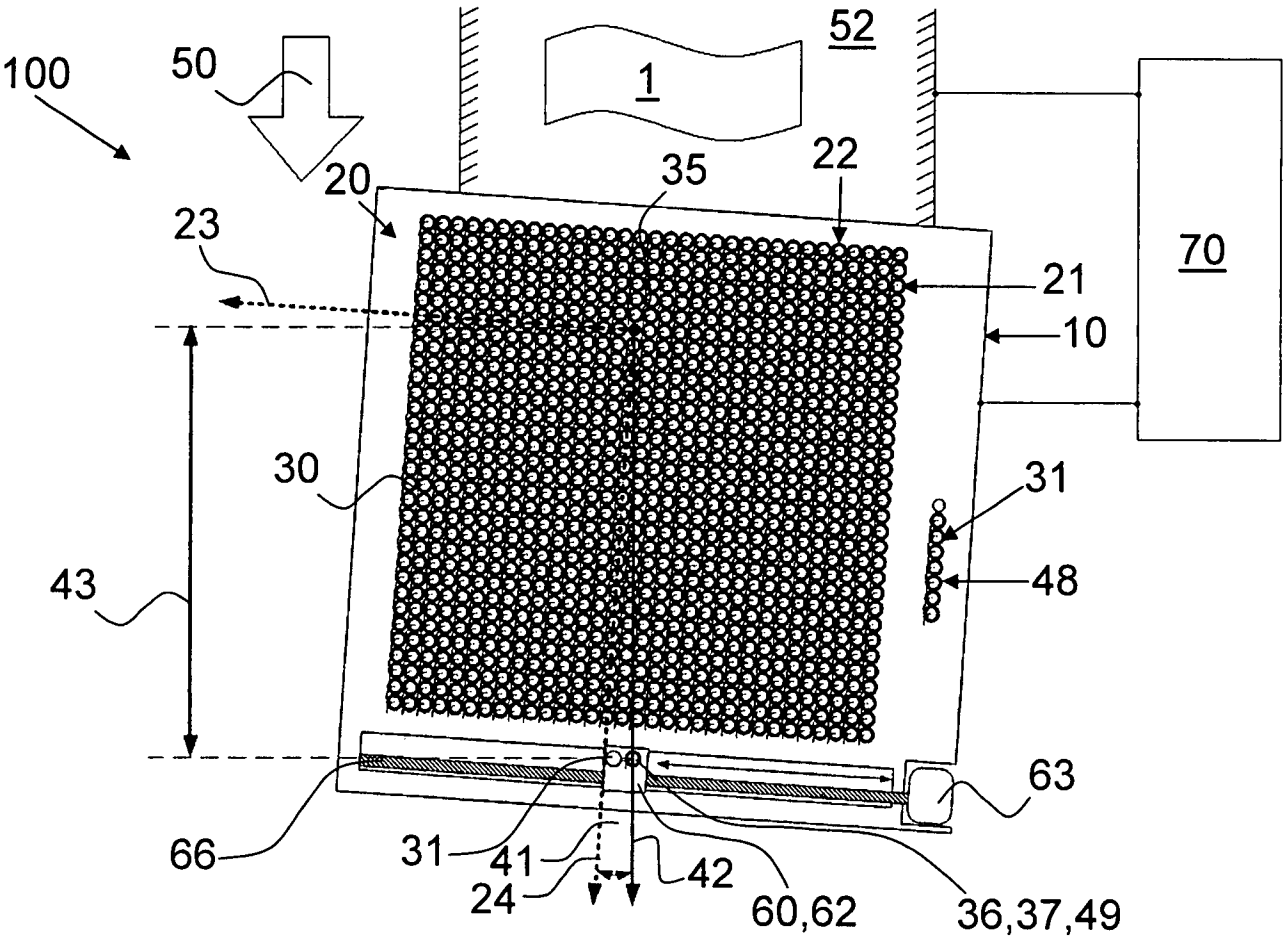
FIG. 6 a schematic diagram of a third embodiment of a device according to the invention.

Another particularly preferred embodiment of a device 100 for marking and/or scanning according to the invention is depicted in FIG. 6.

Once again, the device 100 comprises a head 10, and a driving mechanism 52 for moving an object 1 in an advance direction 50.

The head 10 comprises a rectangular pattern 20 consisting of rows 21 and columns 22 of a plurality of regular operating elements 30.

The rectangular pattern 20 is rotated such that it forms an angle 41 between the advance direction 50 and a direction of the columns 22.

Furthermore, spare operating elements 31 are provided at a position 48 outside an area used for marking and/or scanning.

In this preferred embodiment, a slider 62 is provided as movement means 60. Connected to the slider 62 is one of the spare operating elements 31 such that the spare operating element 31 can be moved relatively to the regular operating elements 30 by moving the slider 62.

The slider or carriage 62 is moved on a threaded rod 66 by a motor 63, in particular a stepper engine. If the head 10 comprises a receiving plate, the threaded rod 66 may be arranged at least partially in an opening or a cut-out of the receiving plate.

The motor 63 can be controlled by a control and evaluation unit 70 which may be connected to the head 10 or may form a part of the head 10. The control and evaluation unit 70 can also be connected to the driving mechanism 52 in order to control the movement of the object 1 or to determine the speed of movement.

The slider 62 further carries detecting means 36 for detecting markings applied on the object 1 by the regular operating elements 30. To this end, the detecting means 36 may be a monitoring element 37 such as a light sensing element.

The monitoring element 37 may be used for determining the tilting angle 41. Alternatively or additionally, the monitoring element 37 may used for determining whether a regular marking element 30 is defective as well as the position of this defective marking element 35 in the advance direction 50.

For determining the tilting angle 41, a regular marking element 30 is activated for applying a reference marking onto the object 1. Subsequently, the slider 62 is moved until the monitoring element 37 measures the reference marking. In this position, the monitoring element 37 is aligned with the activated regular marking element 30 in the advance direction 50. However, regarding the direction of the column 22 of the activated regular marking element 30, the slider 62 is offset by what will be called a slider offset.

As the row 21 and the column 22 of the activated regular marking element 30 are known, e.g. previously determined with a camera that takes pictures of the whole rectangular pattern 20, this slider offset can be readily determined. From the row information of the regular marking element 30, the distance between the slider and the activated regular marking element 30 in a direction of the columns 22 is known.

The tilting angle 41 or α can then be calculated based on the formula:

$$\tan(\alpha)=\text{slider offset/distance in direction of the columns.}$$

However, the monitoring element 37 can be used as well for detecting a defective marking element 35. To this end, the monitoring element 37 is moved and monitors at the same time markings applied onto the object. The monitored markings are evaluated by the control and evaluation unit 70 to determine whether a regular operating element is defective. This may be carried out during regular operation. However, in order to facilitate this evaluation and to speed up the monitoring process, it may be provided that a reference pattern is applied to the object wherein the control and evaluation unit 70 activates the regular operating elements 30 in a predetermined order, particularly one after another. Preferably, the predetermined order is such that the slider 62 has to be moved only once across the width of the rows 21 for monitoring a marking of each regular operating element 30. The time need of this process is thus advantageously reduced.

As soon as the spare operating element 31 is aligned with the defective operating element 35 in the advance direction 50, it can be driven to replace the defective operating element 35. As the spare operating element 31 and the defective operating element 35 are displaced to another in the advance direction 50 by an advance displacement 43, there is a time delay between the moment when the object 1 reaches the defective operating element 35 and the moment when the object reaches the spare operating element 31. This time delay may be calculated by dividing the advance displacement 43 by the object's speed in the advance direction.

In this way, a defective operating element can be replaced within seconds. It is even possible to detect whether a regular operating element is defective and subsequently replace it within a few seconds.

With the device according to the invention, by tilting the marking and/or scanning head it is possible to achieve a particularly good resolution. Additionally, though tilted, a defective operating element can be easily replaced, particularly in a fully automatic way. Downtimes for replacement are advantageously minimized in that additional operating elements, i.e. spare operating elements, are provided in the vicinity of the regular operating elements.

The invention claimed is:

1. A device for at least one of marking and scanning an object comprising:

a head having a plurality of regular operating elements for at least one of marking and scanning the object, and comprising a driving mechanism for providing a relative movement of the object relative to the head in an advance direction during a working operation, at least a part of the regular operating elements being arranged in a rectangular pattern of rows and columns, wherein, the head is provided with at least one spare operating element which is idle in case that all regular operating elements are functioning, the at least one spare operating element is completely connected and ready for use in the idle state, the at least one spare operating element is movable relative to the regular operating elements, in case that one of the regular operating elements is defective, the at least one spare operating element is movable into a position in which the defective operating element is replaced by the spare operating element and the at least one spare operating element is settable to an active state.

2. The device of claim 1, wherein for replacing the defective operating element, the spare operating element is movable into a position in which it is aligned with the defective operating element in the advance direction.

3. The device of claim 1, wherein the head further comprises movement means, the movement means being connected to the at least one spare operating element, and the movement means are movable in order to position the at least one spare operating element relative to the regular operating elements.

4. The device of claim 3, wherein the movement means comprise at least one spare operating element ring, and the spare operating element ring is rotatable in order to position the at least one spare operating element relative to the regular operating elements.

5. The device of claim 3, wherein the movement means comprise at least one slider onto which the at least one spare operating element is mounted, and the slider is movable in order to position the at least one spare operating element relative to the regular operating elements.

6. The device of claim 1, wherein the regular operating elements comprise regular marking elements for applying markings on the object, and the spare operating element comprises a spare marking element.

7. The device of claim 1, wherein detecting means for detecting a defective operating element is provided.

8. The device of claim 1, wherein a control and evaluation unit is provided which is adapted to determine the position of the defective operating element in the advance direction and in a direction perpendicular to the advance direction.

9. The device of claim 8, wherein a monitoring element is provided as means for detecting a defective operating element, the monitoring element is adapted to measure markings applied on the object by the regular marking elements and a control and evaluation unit is provided which is adapted to determine whether a regular marking element is defective on the basis of the measured markings on the object.

10. The device of claim 1, wherein the head further comprises a motor for positioning the at least one spare operating element and a control and evaluation unit is provided for driving the motor to position the spare operating element into the position in which it is aligned with the defective operating element in the advance direction.

11. The device of claim 1, wherein a control and evaluation unit is provided being adapted to drive the regular operating elements and the at least one spare operating element, the control and evaluation unit further being adapted to drive the defective operating element time delayed in case the spare operating element is in an active state, wherein the time delay corresponds to the distance between the spare operating element and the defective operating element in the advance direction divided by the speed of the object relative to the head caused by the driving mechanism.

12. The device of claim 1, wherein the rectangular pattern of regular operating elements is tilted with regard to the advance direction such that the rows extend in a transverse direction relative to the advance direction and the regular operating elements of a successive row of the rectangular pattern are offset with regard to the regular operating elements of a preceding row of the rectangular pattern in a direction perpendicular to the advance direction.

13. The device of claim 12, wherein the amount of offset of the regular operating elements of a successive row with regard to the regular operating elements of a preceding row is smaller than a pitch of the regular operating elements of one row.

14. A method for at least one of marking and scanning an object, with the device of claim 1, wherein the object is moved relative to the head in the advance direction during a working operation, and a marking or scanning of the object is carried out by the plurality of regular operating elements, at least the part of the regular operating elements are arranged in the rectangular pattern of rows and columns, the at least one spare operating element is provided and kept in an inactive state as long as all regular operating elements are functioning, wherein the at least one spare operating element is completely connected and ready for use in the inactive state, in case that one of the regular operating elements is defective, the at least one spare operating element is moved into the position in which it replaces the defective operating element and the at least one spare operating element is activated.

* * * * *